United States Patent [19]

Gährs

[11] Patent Number: 4,561,452

[45] Date of Patent: Dec. 31, 1985

[54] PROCEDURE FOR PRODUCING LOW NICOTINE TOBACCO BY MEANS OF HIGH PRESSURE EXTRACTION

[75] Inventor: Hans J. Gährs, Düsseldorf, Fed. Rep. of Germany

[73] Assignee: Messer Griesheim GmbH, Frankfurt am Main, Fed. Rep. of Germany

[21] Appl. No.: 644,572

[22] Filed: Aug. 27, 1984

[30] Foreign Application Priority Data

Sep. 26, 1983 [DE] Fed. Rep. of Germany ..... 3334736

[51] Int. Cl.[4] ..... A24B 15/24

[52] U.S. Cl. ..... 131/297

[58] Field of Search ..... 131/297, 298, 291

[56] References Cited

U.S. PATENT DOCUMENTS 4,153,063 5/1979 Roselius ..... 131/297

4,289,148 9/1981 Ziehn ..... 131/291

FOREIGN PATENT DOCUMENTS 1106468 3/1968 United Kingdom ..... 13/297

*Primary Examiner*—V. Millin

*Assistant Examiner*—H. Macey

*Attorney, Agent, or Firm*—Connolly and Hutz

[57] ABSTRACT

High pressure of nicotine with a compressed gaseous solvent is used for producing low nicotine tobacco. A mixture of nitrogen and carbon dioxide with the nitrogen being 50–80 percent of the mixture is used. The extraction is carried out at pressures between 250 and 600 bar at temperatures above 50° C.

8 Claims, 4 Drawing Figures

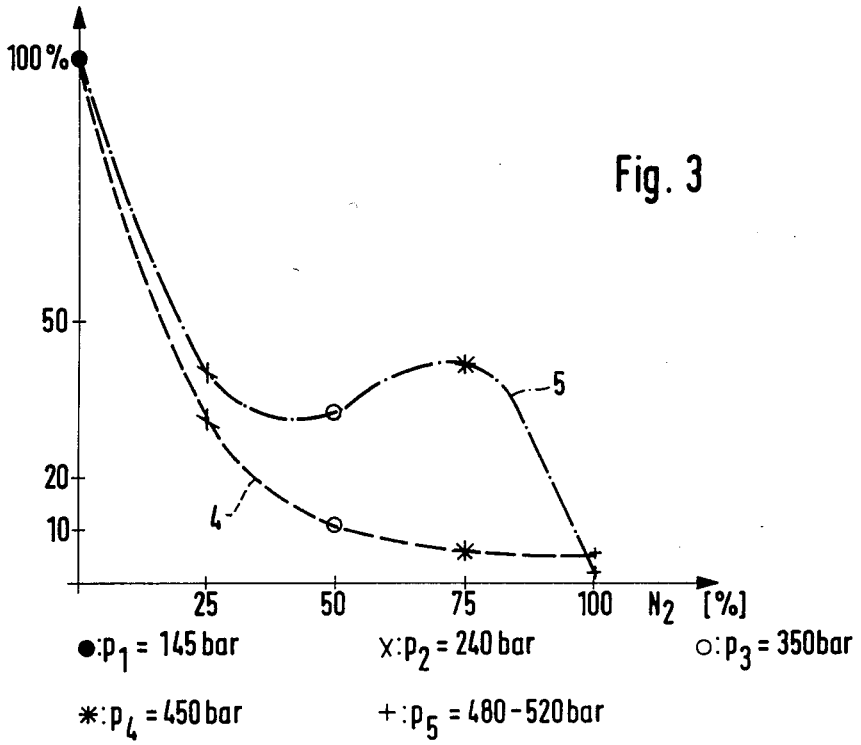
Fig. 3
Fig. 4
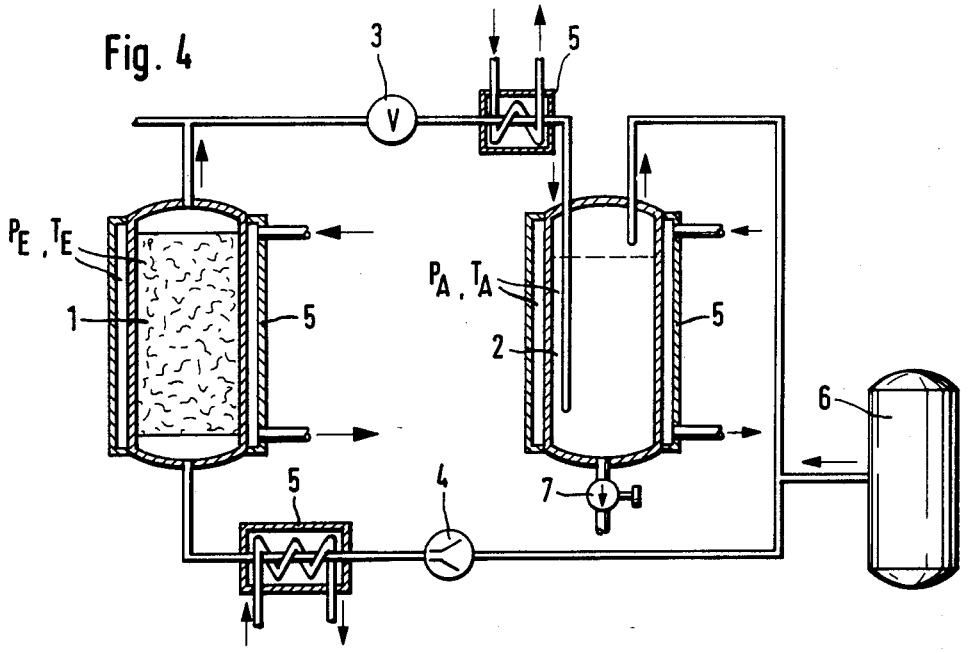

PROCEDURE FOR PRODUCING LOW NICOTINE TOBACCO BY MEANS OF HIGH PRESSURE EXTRACTION

BACKGROUND OF THE INVENTION

The invention concerns a procedure for producing low nicotine tobacco by means of high pressure extraction of the nicotine, using a compressed gaseous solvent, as well as subsequent increase of the filling volume of the tobacco.

By means of various gaseous solvents under high pressure, it is possible to remove a significant portion of the nicotine from tobacco. The applied pressures can be so high that the solvents are in the liquid or in the overcritical condition. DE-OS No. 20 43 537 cites e.g., $CO_2$, $N_2O$ and Ar as suitable gaseous solvents. The disadvantage of this procedure is that in addition to the nicotine, other substances are partially extracted as well, e.g., those creating the aroma. According to a procedure known from the DE-OS No. 21 42 205, this disadvantage is avoided by extracting the aroma substances separately, prior to the de-nicotinization and adding these aroma substances back to the tobacco after extracting the nicotine. This procedure is relatively costly, and the possibility cannot be excluded that the aroma substances, which are partially complicated and sensitive, are negatively influenced by such manipulations.

Another possibility to reduce the nicotine contents of tobacco products is to improve the fill volume of the tobacco used, i.e., to increase its specific volume ($cm^3/g$). For this purpose, the tobacco is impregnated with liquid or overcritical gases under pressure; subsequently, it is released and thermally after-treated by means of increased temperature. As suitable impregnation gases for this purpose, $N_2$ or Ar are mentioned in DE-OS No. 29 03 300, liquid $CO_2$ in U.S. Pat. No. 4,258,729.

However, these procedures for swelling the tobacco only cause approximately a doubling of the specific volume or the fill value. Thus, the nicotine contents of tobacco products pretreated in this manner can only be reduced to approximately 50 percent.

SUMMARY OF THE INVENTION

An object of the invention is to create a procedure for producing low nicotine tobacco by means of high pressure extraction, which allows far-reaching isolated removal of the nicotine without simultaneously extracting other substances contained in the tobacco, particularly aroma components. In an advantageous further development, the invention will allow an increase of the fill volume of the tobacco immediately subsequent to the nicotine extraction by means of pressure drop and thermal treatment, and thus also a further decrease of the specific nicotine contents.

In principle the invention is based on the knowledge that, surprisingly, mixtures of nitrogen and carbon dioxide with specific proportions have an almost selective dissolving effect on nicotine, although nitrogen by itself has very low solvent capacity, at least in the pressure area up to 500 bar. For all other substances contained in tobacco, the mixtures of nitrogen and carbon dioxide behave as does pure nitrogen, i.e., they represent a very bad solvent. Thus, the mixtures of nitrogen and carbon dioxide differ most advantageously from pure carbon dioxide, which, although its solvent capability for nicotine is excellent already at low pressures, also dissolves numerous substances contained in the tobacco, such as wax and aroma substances.

A specific advantage of the procedure according to the invention is that the pressure and the composition of the nitrogen-carbon dioxide mixture can be selected so that immediately after the selective extraction of the nicotine, there can be a release and a thermal after-treatment of the tobacco based on a pressure which is optimal for this procedure for increasing the fill volume of the tobacco. Consequently, no additional pressure change is required after the selective nicotine extraction; rather, the swelling procedure, which is known, per se, can be carried out immediately at the existing pressure. The result is an economically very favorable total procedure.

The selection of optimum pressure for the procedure according to the invention is primarily based on the humidity contents of the tobacco and the solvent. Usually, working temperatures above 50° C. are required, but in special cases, temperatures down to 40° C. may be sufficient.

The separation of the extracted nicotine may be achieved by means of changing the pressure and/or the temperature. The separation of the nicotine can be achieved particularly advantageously by admixture of an additional component to the solvent or by changing the composition of the solvent by admixture of one of the two components nitrogen or carbon dioxide.

The procedure according to the invention is implemented with a flow rate of at least 5 kg solvent per kg raw material, preferably with a flow rate of 15–25 kg solvent per kg raw material. This leads to a reduction of the nicotine contents in the raw material by at least 80 percent to more than 90 percent. A further reduction of the nicotine contents can be achieved if the raw material is released from the extraction pressure immediately after the extraction and is subsequently subjected to thermal after-treatment. For this, a short term temperature increase to at least 100° C., preferably to 150°–350° C., will suffice. An increase of the specific volume by at least 20 percent, normally from 40 percent to 70 percent, is achieved through the rapid removal of the gas components dissolved in the raw material.

THE DRAWINGS

FIG. 3 shows the dependencies of the relative extraction yield and of the relative maximum nicotine concentrations as a function of the composition of the solvent; and FIG. 4 shows a diagram of the procedure according to the invention.

DETAILED DESCRIPTION

Figure 1:
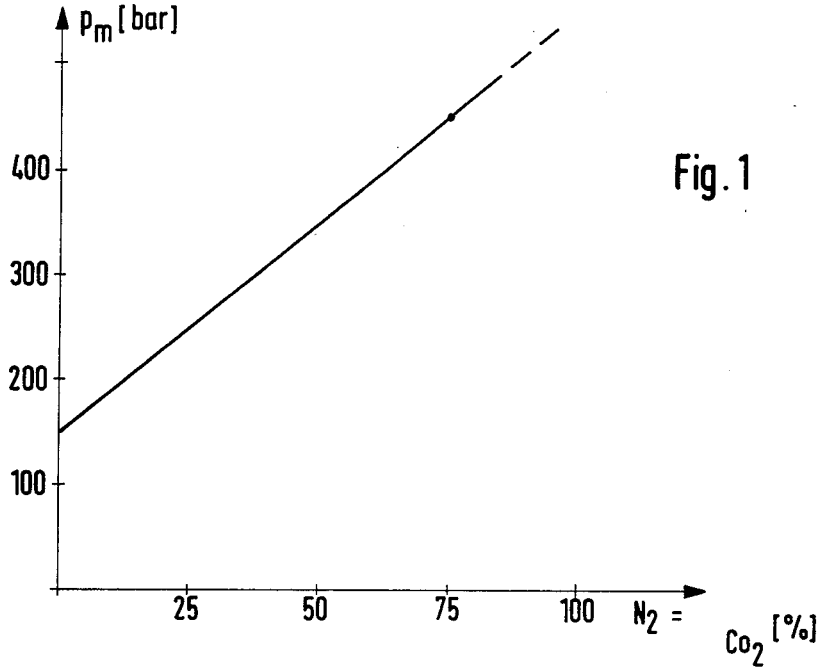
FIG. 1 shows the pressure for maximum nicotine solubility as a function of the composition of the solvent.
Figure 2:
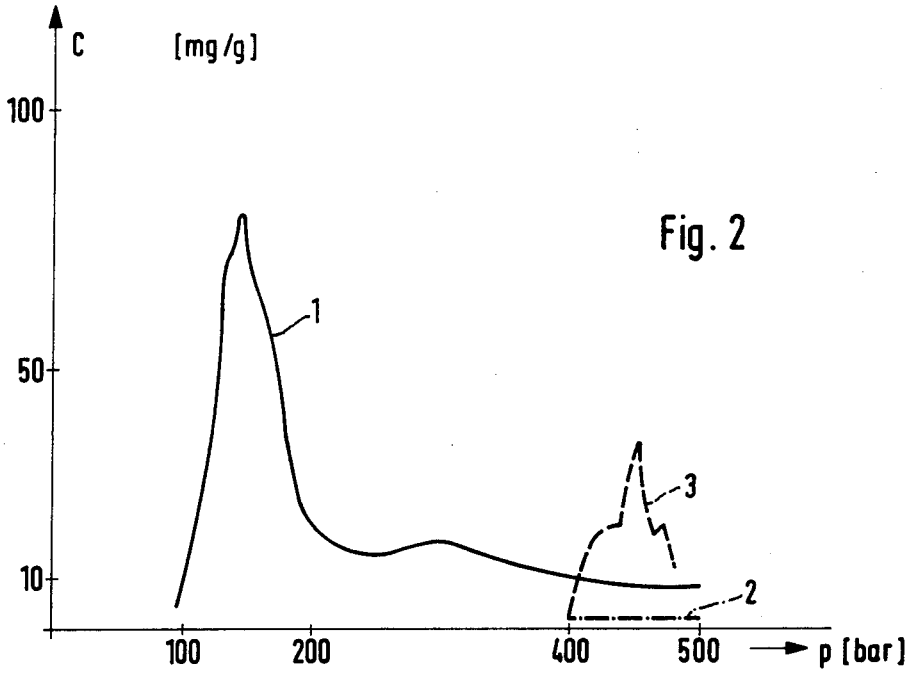
FIG. 2 shows the nicotine solubility as a function of the pressure for pure carbon dioxide, pure nitrogen, and a mixture of 75 percent nicotine and 25 percent carbon dioxide.

FIG. 1 shows the optimum pressures $p_m$ in bar for nicotine extraction with dry carbon dioxide as a function of the composition of the nitrogen-carbon dioxide mixture. In each case, the pressures for maximum nicotine solubility are shown, namely at a temperature of 50° C. FIG. 2 shows the nicotine solubility as a function of the pressure at 50° C. for the various solvents. Curve 1 indicates the solubility of carbon dioxide, Curve 2 that of nitrogen and Curve 3 that of a mixture according to the invention, namely of 75 percent nitrogen and 25 percent carbon dioxide. As the representation shows, pure nitrogen is practically unusable as solvent, while pure carbon dioxide represents an excellent solvent already at low pressures. However, in addition to nicotine, pure carbon dioxide also extracts other substances contained. Surprisingly, this is not the case for a solvent mixture of 75 percent nitrogen and 25 percent carbon dioxide according to the invention.

It is true that the total solubility is lower than that of pure carbon dioxide, but on the other hand, a practically selective extraction of the nicotine is possible. In addition, the high pressures required can be immediately utilized for increasing the fill volume of the raw material.

An approximate formula for the dependency of the optimum pressure on the composition of the solvent can be stated for a temperature of 50° C.:

$$p_m = p_{g.T} c_{N_2} + p_0$$

whereby it is approximated that $p_O = (150 \pm 50)$ bar and $p_{g.T} = (400 \pm 50)$ bar. The exact values depend on the humidity of the raw material and the solvent, as well as of the type and the pretreatment of the tobacco.

FIG. 3 shows the dependencies of the relative extraction yields and of the relative maximum nicotine concentrations as functions of the solvent composition at 50° C. Curve 4 indicates the relative extraction yield $E(N_2/CO_2)/E(CO_2)$. Thereby, $E(CO_2)$ is the total extraction yield with a flow rate of 10 kg mixture of nitrogen/carbon dioxide per kg raw material; $E(N_2/CO_2)$ is the extract quantity yielded with a flow rate of 10 kg mixture of nitrogen/carbon dioxide at the optimum pressure for each composition. Curve 5 indicates the relative nicotine saturation concentration $c_N(N_2/CO_2)/C_N(CO_2)$, as a function of the solvent composition at 50° C. While the extraction yield falls rapidly and continuously with increasing nitrogen content in the solvent mixture, the nicotine solubility remains at a good 40 percent of the value for pure carbon dioxide even with 75 percent nitrogen content, although nitrogen has practically no nicotine solubility at 450 bar and shows barely measurable values even at 520 bar.

The advantages of the procedure according to the invention are immediately apparent from the figures. The composition of the solvent mixture of nitrogen and carbon dioxide has an extreme influence on the selectivity of the extraction process in favor of the nicotine and displaces the optimum pressure for extraction of nicotine to values which make a subsequent improvement of the fill volume by means of thermal after-treatment very efficient.

By means of a diagram, FIG. 4 shows an execution example of the procedure according to the invention. The raw material for the nicotine extraction was commercially available pipe tobacco.

ANALYSIS DATA

Dry substance content: TS=85.60%

TS nicotine content rel. to $C_{Nic}$=0.94%

The tobacco is moistened to approximately 25 percent TS, and in the extractor, the solvent taken from storage tank 6 flows through it. In the compressor 4, the pressure of the solvent was accordingly increased, and in the heat exchanger 5, the corresponding temperature increase was effected. The separation occurs by means of releasing (valve 3), the extract is removed from the separator 2. The conditions for extraction and separation are indicated in Table I, the extraction result in Table II.

TABLE I

| | Extraction conditions | | Separation conditions | |
|---|---|---|---|---|
| SOLVENT | $P_E$ (bar) | $T_E$ (°C.) | $P_A$ (bar) | $T_A$ (°C.) |
| $CO_2$ | 100-200 | 50 | 60 | 25 |
| 75% $N_2$ 25% $CO_2$ | 350-500 | 50 | 60 | 25 |

TABLE II

| SOL-VENT | Throughflow per kg raw material (kg) | Extract per kg raw material (g) | Nicotine reduction (%) |
|---|---|---|---|
| $CO_2$ | 23.6 | 173 | 87 |
| $N_2/CO_2$ | 24.1 | 12.2 | 85 |

For similar nicotine reduction processes, there were significant differences in the qualitative and sensorial evaluation of the raw material after the extraction: the tobacco treated with $CO_2$ was much drier (TS 92 percent) and almost without aroma. On the other hand, the tobacco treated with $N_2/CO_2$ was characterized by almost unchanged aroma content, and the humidity was only insignificantly decreased. In both tests, the treated tobacco was somewhat swelled. However, the increase of the specific volume does not become apparent until after thermal aftertreatment subsequent to extraction and release.

SUMMARY

The nicotine content of tobacco can be decreased by means of partial removal of the nicotine and by means of increase of the fill volume, e.g., the specific volume of the tobacco. The removal of the nicotine is achieved by means of high pressure extraction with the aid of compressed gaseous solvents. In order to increase the fill volume, the tobacco is impregnated with liquid or overcritical gases, and subsequently released and thermally after-treated. The disadvantage of currently applied procedures for nicotine removal under high pressure is that aroma substances are also extracted. In order to leave at least most of the aroma substances in the tobacco, a solvent is used which consists of a mixture of nitrogen and carbon dioxide, with a nitrogen content of 50 to 80 percent. The optimum pressures suitable for selective nicotine extraction, namely 250 to 600 bar, are also optimally suited for increasing the fill volume of the tobacco, insofar that the tobacco is released immediately after the extraction and is subjected to a thermal after-treatment.

What is claimed is:

1. In a procedure for producing low nicotine tobacco by means of high pressure extraction of the nicotine by means of a compressed gaseous solvent, the improvement being in mixing nitrogen and carbon dioxide with a proportion of 50 to 80 percent nitrogen, and extracting the nicotine at pressures between 250 and 600 bar and at temperatures above 50° C.

2. Procedure according to claim 1, characterized thereby that the content of nitrogen in the solvent amounts to 70 to 80 percent and that the extraction is carried out at pressures from 300 to 600 bar.

3. Procedure according to claim 2, characterized thereby that the nicotine is separated from the solvent by changing the composition of the solvent after it has left the extraction container.

4. Procedure according to claim 3, characterized thereby that in order to increase the fill volume of the tobacco, the tobacco is released after the extraction of the nicotine and is subjected to a thermal after-treatment at temperatures between 100° and 300° C.

5. Procedure according to claim 4, characterized thereby that the thermal after-treatment is carried out at temperatures between 150° and 300° C.

6. Procedure according to claim 2, characterized thereby that in order to increase the fill volume of the tobacco, the tobacco is released after the extraction of the nicotine and is subjected to a thermal after-treatment at temperatures between 100° and 300° C.

7. Procedure according to claim 1, characterized thereby that the nicotine is separated from the solvent by changing the composition of the solvent after it has left the extraction container.

8. Procedure according to claim 1, characterized thereby that in order to increase the fill volume of the tobacco, the tobacco is released after the extraction of the nicotine and is subjected to a thermal after-treatment at temperatures between 100° and 300° C.

* * * * *